US007452402B2

(12) United States Patent
Bryant et al.

(10) Patent No.: US 7,452,402 B2
(45) Date of Patent: Nov. 18, 2008

(54) METHOD FOR PRODUCING FOAMED ALUMINUM PRODUCTS BY USE OF SELECTED CARBONATE DECOMPOSITION PRODUCTS

(75) Inventors: J. Daniel Bryant, Murrysville, PA (US); Jacob A. Kallivayalil, Pittsburgh, PA (US); Mark D. Crowley, Pittsburgh, PA (US); Joseph R. Genito, Lower Burrell, PA (US); Larry F. Wieserman, Apollo, PA (US); Deborah Murphy Wilhelmy, Greensburgh, PA (US); William E. Boren, Jr., Export, PA (US)

(73) Assignee: Alcoa Inc., Pittsburgh, PA (US)

( * ) Notice: Subject to any disclaimer, the term of this patent is extended or adjusted under 35 U.S.C. 154(b) by 59 days.

(21) Appl. No.: 11/119,002

(22) Filed: Apr. 29, 2005

(65) Prior Publication Data

US 2006/0243094 A1 Nov. 2, 2006

(51) Int. Cl.
*C22B 21/06* (2006.01)

(52) U.S. Cl. ..... 75/684

(58) Field of Classification Search ..... 75/415, 75/684

See application file for complete search history.

(56) References Cited

U.S. PATENT DOCUMENTS

| | | | | |
|---|---|---|---|---|
| 2,751,289 | A | 6/1956 | Elliott | 75/20 |
| 2,895,819 | A | 7/1959 | Fiedler | 75/20 |
| 2,983,597 | A | 5/1961 | Elliott | 75/20 |
| 3,005,700 | A | 10/1961 | Elliott | 75/20 |
| 3,214,265 | A * | 10/1965 | Fiedler | 75/415 |
| 3,297,431 | A | 1/1967 | Ridgway, Jr. | 75/20 |
| 3,360,361 | A | 12/1967 | Albright et al. | 75/20 |
| 3,671,221 | A | 6/1972 | Berry, Jr. | 75/20 |
| 3,707,367 | A | 12/1972 | Bjorksten et al. | 75/20 |
| 3,981,720 | A | 9/1976 | Speed | 75/20 |
| 4,713,277 | A | 12/1987 | Akiyama et al. | 428/131 |
| 5,112,697 | A | 5/1992 | Jin et al. | 428/613 |
| 5,622,542 | A | 4/1997 | Thomas et al. | 75/415 |
| 5,632,319 | A | 5/1997 | Yang et al. | 164/79 |
| 6,250,362 | B1 | 6/2001 | Rioja et al. | 164/46 |
| 6,808,003 | B2 | 10/2004 | Raghunathan et al. | 164/98 |
| 2003/0126949 | A1 | 7/2003 | Hur et al. | 75/415 |
| 2003/0154820 | A1 * | 8/2003 | Nakamura et al. | 75/415 |
| 2004/0079198 | A1 | 4/2004 | Bryant et al. | 75/415 |
| 2004/0163492 | A1 | 8/2004 | Crowley et al. | 75/415 |
| 2005/0035502 | A1 | 2/2005 | Hur et al. | |
| 2006/0243095 | A1 * | 11/2006 | Bryant et al. | 75/415 |

FOREIGN PATENT DOCUMENTS

| | | |
|---|---|---|
| JP | 55-138039 | * 10/1980 |
| JP | 2001380522 | 7/2003 |
| JP | 2003183622 A | * 7/2003 |

OTHER PUBLICATIONS

English translation of Japanese patent document 55-138039.*

* cited by examiner

*Primary Examiner*—Roy King
*Assistant Examiner*—Tima M McGuthry-Banks
(74) *Attorney, Agent, or Firm*—Greenberg Traurig, LLP

(57) ABSTRACT

A method for producing an aluminum foam product wherein reactive gas producing particles are introduced into an aluminum alloy melt under controlled conditions and subjected to agitation to induce the production of foam-stabilizing by-products, and, under certain conditions, the production of gases used to produce the molten metal foam itself. Foam products produced through this method have intrinsically formed metal oxides and other solid particles dispersed therein and are devoid of the large extrinsically added stabilizing ceramic additions traditionally used in the production of aluminum foams. The invention claims a rapid, single step method for producing an inoculated, foamable melt using low cost precursor materials.

18 Claims, 11 Drawing Sheets

METHOD FOR PRODUCING FOAMED ALUMINUM PRODUCTS BY USE OF SELECTED CARBONATE DECOMPOSITION PRODUCTS

FIELD OF THE INVENTION

The present invention relates generally to foamable metals, and more particularly, to a method for forming metal foam products in which reactive particles decompose within a metal melt to produce foam stabilizing by-products and gases suitable for foaming metal.

BACKGROUND INFORMATION

Low-density porous products offer unique mechanical and physical properties. The high specific strength, structural rigidity and insulating properties of foamed products produced in a polymer type matrix are well known. Such closed cell polymeric foams are used extensively in a wide range of applications, including construction, packaging and transportation.

While polymeric type foams have enjoyed wide market success, foamed metal products have seen only limited applications. Closed cell metallic foams offer many of the attractive attributes of polymeric foam with respect to many light weight applications. In addition, the inherently higher bulk modulus of metals, as compared to polymers, provides higher specific rigidity. This higher bulk modulus makes metal foams an attractive candidate for core materials in laminate panels, in which rigidity and resistance to deflection are important performance measures. Additionally, panels produced from foamed metal are fire and smoke resistant and are well suited for construction applications. Aluminum foam core sandwich composite products offer the additional environmental benefit of being recyclable; an issue that has restricted the use of metal clad polymer foams.

While methods of producing foamed metals have been described in the scientific and patent literature, such materials suffer from problems such as high cost, large cell sizes, cell size variability and insufficient structural integrity. Many of these problems are associated with the rheology of the molten metal. In substantially all casting metallurgy methods of producing metallic foams some stabilization is required in the metallic melt. Foams are meta-stable and therefore prone to both cellular coalescence and cell wall drainage.

Conventionally, in order to achieve the required stabilization for producing metal foams, particulates, such as ceramic particles, are introduced into the melt. These particulates effectively change the nature of the melt by increasing the effective viscosity of the melt and/or decreasing the effective surface tension of the liquid. These particulates must be small relative to the desired cell wall thickness of the foam. Incorporating small particulates into the melt is traditionally achieved using either intrinsic or extrinsic methods, wherein each method has disadvantages limiting their usefulness.

In intrinsic particle formation a gas is stirred into the molten metal, either by vortexing mechancal mixers and/or bubbling of gas (direct gas injection) through the melt. The gas reacts with the melt to form small particles including oxides, spinels and/or other unique particles. Controlling the size, geometry and volume fraction of the particles formed to create a stable, foamable matrix is particularly difficult.

The size of the particles formed is affected by the size of the gas bubbles injected or entrained. Producing small gas bubbles in liquid metal is notoriously difficult. Additionally, melt temperature, time at melt temperature, gas composition, stirring rate and melt composition all affect the rate, amount and characteristics of the particles and their distribution. Further, in aluminum melts, it is often necessary to add highly reactive alkali metals to promote such oxidation reactions.

One disadvantage of direct gas injection and/or stirring in providing foamed metals is the time required to create a stable foamable matrix. Time scales on the order of 20 minutes to several hours are often required even for small quantities of molten metal and larger quantities of molten metal often require much longer times to achieve the rheological character required to create a stable metal foam.

Extrinsic particle addition also suffers from a number of disadvantages which limit its usefulness as a method of stabilizing metal for foaming. In extrinsic particle addition small, inert particles are directly added and mixed into the melt. One disadvantage of extrinsic particle addition is that the extrinsically added particulates must be wetted so they remain suspended in the melt.

In an effort to wet extrinsically added particles, prior methods have utilized special alloying of the melt and/or particle coatings; sequencing of the melt alloy concentration and/or particulate addition; tight requirements on particle quality/surface composition; and elaborate equipment to control and enhance the wetting process between the particulates and the molten metal by imposing high shear in a vacuum or inert environment. These technical challenges translate into exotic processing equipment and limitations on the size and purity of the extrinsic particles used. These barriers have prevented the economical production of metal foams produced through extrinsically stabilized melts.

U.S. Pat. No. 3,297,431 to Ridgeway Jr. ("Ridgeway Jr.") requires the use of stabilizer powders to maintain and preserve the cellular structure of aluminum foam upon cooling. As described in Ridgeway Jr., such stabilizing particles are finely divided inert powders which are wetted by the molten metal and are stable in the molten metal. The use of stabilizer particles is also described in U.S. Pat. No. 5,112,697 to Jin et al. ("Jin et al."), in which Jin et al. defines precise limits on the size and volume fractions of such "finely divided stabilizer particles". Additionally, U.S. Patent Application Publications U.S. 2004/0163492A1 and 2004/0079198A1 (Crowley et al. and Bryant et al. respectively) disclose the use of surface coatings on such viscosity control agents in foaming aluminum. All of these disclosures have their own disadvantages.

In light of the above-described obstacles and disadvantages, there is a need to provide a more commercially attractive means of metal foam production.

SUMMARY OF THE INVENTION

The present invention provides an economical metal foaming process using a minimum of precursor, a minimum number of process steps, and being workable at temperatures and pressures suitable for aluminum processing. Broadly, the present invention provides a method of making foamed aluminum comprising the steps of:

providing reactive gas producing particles having a decomposition temperature at atmospheric pressure from about 350° C. to about 850° C.;

combining the reactive gas producing particles with molten metal alloy comprising aluminum;

agitating the molten metal alloy containing said reactive gas producing particles to decompose a first portion of the reactive gas producing particles into a reactive gas and retain a second portion of the reactive gas producing particles in an unreacted state, wherein the reactive gas vigorously combines with the molten metal alloy to produce metallic oxide phases and the second portion of the reactive gas producing particles in the unreacted state are chemical foaming agents in an inoculated foamable melt;

foaming the inoculated foamable to produce a liquid metal foam; and solidifying the liquid metal foam to create a foamed aluminum product.

The molten metal alloy comprising aluminum may be commercial grade purity aluminum; scrap aluminum; aluminum containing silicon and magnesium; and mixtures thereof. In some embodiments, magnesium may be in solution in the molten metal alloy in the range of about 0.5 wt. % to about 8 wt. %.

The reactive gas producing particle is selected from the group consisting of calcium carbonate, magnesium carbonate, magnesium-calcium carbonate (dolomite) or mixtures thereof. Calcium carbonate is particularly effective as a reactive gas producing particle and/or as a foaming agent. In this process, with calcium carbonate, the carbonate decomposes within the molten metal and forms CaO solids and the reactive gas $CO_2$. Under conditions of aggressive agitation, the gas bubbles formed within the molten metal are ruptured and fragmented, exposing more of the reactive gas to the molten metal. This gas reacts vigorously with the molten aluminum forming CO gas and in-situ formed $Al_2O_3$. The $Al_2O_3$, as well as the CaO and other compounds, are metallic oxide phases that stabilize the liquid metal foam by modifying the viscosity and surface energy of the molten metal. The term "vigorous" denotes the exothermic nature of the reaction and the production of flammable gas.

In aluminum alloy melts, other metal oxides may also be formed as by-products of the decomposition of the reactive gas. For example, in Al—Mg alloys, the reactive gas $CO_2$ decomposes to form CO and the metal oxide MgO along with $Al_2O_3$ and various mixed metal oxides. Other traditional aluminum alloying elements form similar finely dispersed metal oxides within the agitated melt. Similar to $Al_2O_3$ and CaO, MgO is an example of a metal oxide phase, which when incorporated into the molten metal modifies the viscosity and surface energy of the molten metal to create a foamable liquid. The term "foamable" is defined as having the capability of stabilizing a liquid foam so that it resists coalescence and drainage. Coalescence is the disappearance of the boundary between two particles foamed bubbles in contact, resulting in a coarsening of the liquid foam structure. Drainage is an increased introduction of a density gradient within the liquid foam resulting in a loss of structural uniformity in the liquid foam.

The generation of mixed metal oxide phases from the decomposition of the reactive gas producing particles is very rapid, and is complete within 2 to 8 minutes under optimum conditions. Alloy composition, particle size distribution, temperature and degree of agitation all impact the decomposition kinetics. Surprisingly, the decomposition rate of the reactive gas producing particles is greatly accelerated by the presence of sufficient amounts of magnesium within the aluminum melt. The addition of 0.5 wt. % to 8 wt. % Mg significantly reduces the time required to fully decompose the reactive gas producing particles in the agitated melt. This magnesium addition has been shown to not only more the double the decomposition rate of the reactive gas producing carbonate, affording higher processing speeds, but to significantly impact the structure of the foam products produced by changing the cell size, drainage rate and wall thickness.

In one embodiment of the present invention, the reactive gases produced by the decomposition of the reactive gas producing particles, along with the gaseous products of their decomposition, are used to create the bubbles within the liquid foam. More specifically, in this embodiment of the present invention the agitation of the molten metal alloy is purposefully ceased after a portion of the reactive gas producing particles decomposes to leave an unreacted portion of the reactive gas producing particles within the molten metal alloy. Thereafter, the unreacted portion of the reactive gas producing particles functions as a foaming agent to create the liquid metal foam, wherein the metal oxide phases produced by the vigorous combination of the reactive gas and the molten metal alloy stabilize the foam. In one embodiment, a single addition of calcium carbonate into the molten metal alloy in an amount ranging from about 2.0 wt % to about 16.0 wt %, is sufficient to provide both chemical foaming agent and metal oxide phases in an inoculated foamable suspension. In one embodiment of the present invention, the above described method may further include the steps of solidifying the inoculated foamable melt and then remelting the inoculated foamable melt prior to foaming.

In another aspect of the present invention an apparatus is provided for practicing the above-described method. In its simplest implementation, the inventive apparatus requires only one vessel chamber for batch or continuous production of an inoculated molten melt that functions as a foamable charge. In broad terms, the inventive apparatus for forming foamed aluminum product comprises:

a feeding system for providing reactive gas producing particles and molten metal alloy, wherein the molten metal alloy is provided at a preselected flow rate;

a reactor unit in communication with the feeding system comprising:

a mixing unit for combining the reactive gas producing particles and the molten metal alloy into a foamable suspension, the mixing passage having a stirrer contained therein and having a volume configured to provide a transit time through the mixing passage suitable for decomposing at least a portion of the reactive gas producing particles within the mixing passage at the preselected flow rate, at least one vent in the mixing chamber to release gaseous byproducts, and a furnace housing the mixing chamber; and a means for transferring the foamable suspension from the reactor unit.

The transit time of the molten metal alloy containing the gas producing particles through the mixing passage is selected to provide a foamable suspension upon exiting the reactor unit. The transit time may be modified by adjusting the flow rate into the reactor unit and the effective volume of the mixing passage in view of the reactive gas producing particles. More specifically, the reactive gas producing particles composition, decomposition temperature, and particle size must all be considered in adjusting the reactor unit. Finally, the degree of agitation provided by the stirrer must also be considered.

In another embodiment of the invention, the decomposition of the reactive gas producing particles are allowed to proceed under agitation to completion. In this case, the chemical foaming agent is provided through a separate addition of a chemical foaming agent, which may or may not be chemically identical to the reactive gas producing particles. Broadly, the present invention provides method of forming aluminum foam comprises:

providing reactive gas producing particles having a decomposition temperature at atmospheric pressure from about 350° C. to about 850° C.;

combining the reactive gas producing particles with molten metal alloy comprising aluminum;

agitating the molten metal alloy containing the reactive gas producing particles to decompose at least a portion of the reactive gas producing particles into reactive gas, wherein the reactive gas vigorously combines with the molten metal alloy to produce a foamable suspension of metallic oxide phases;

dispersing chemical foaming agents into the foamable suspension to produce an inoculated foamable melt;

foaming the inoculated foamable melt to produce a liquid metal foam; and solidifying the liquid metal foam to create a foamed aluminum product.

In this embodiment of the present invention, the addition of calcium carbonate into the molten metal alloy in an amount ranging from about 0.5 wt. % to about 4.0 wt. % is sufficient to provide sufficient metal oxide phases to stabilize a liquid metal foam. In another embodiment, calcium carbonate may dispersed into the foamable suspension as a foaming agent in a weight percent ranging from about 0.5 wt. % to about 4.0 wt. %. In one embodiment of the present invention, the above described method may further include the steps of solidifying the inoculated foamable melt and then remelting the inoculated foamable melt prior to foaming.

In another aspect of the present invention, an apparatus is provided for practicing the above-described method, in which a chemical foaming agent is separately dispersed into the foamable suspension after the reactive gas producing particles have fully reacted. In its simplest implementation, the apparatus requires at least two stages, in which a first stage introduces the reactive gas producing particles into the molten alloy and a second stage disperses the chemical foaming agent. The first stage may be similar in structure to above-described reactor unit in which the foaming agent is provided by the unreacted portion of the reactive gas producing particles. The second stage for dispersing the chemical foaming agent is in communication with the first stage and comprises a foaming agent mixing chamber for receiving a foamable suspension; a feeding system positioned to provide chemical foaming agent into the foamable suspension within the foaming agent mixing chamber; and a stirrer positioned in the foaming agent mixing chamber.

It is further noted, the reactive gas producing particles used to create the reactive gas produce an even fine distribution of mixed metal oxides far superior to that which could be formed by either bubbling gasses directly into the melt or through other coarse methods such as vortexing. The oxides formed by the decomposition of the reactive gas producing particles also appear to be more effective than conventional methods that introduce stabilizing particles into aluminum melts by extrinsic addition. This refinement in the metallic oxides allows for melt stabilization at substantially lower volume fractions of oxide than heretofore have been required in extrinsically stabilized metallic foams.

As described in U.S. Pat. No. 5,112,697 to Jin et al. ("Jin et al."), the prior art teaches that a minimum effective volume fraction of stabilizing particles of 5% is required when using the finest particulate, with much emphasis placed on the difficulty of dispersing such fine particles within the molten metal. In the present invention, surprisingly and unexpectedly, reactive gas producing particles have been shown to be effective at far lower volume fractions, as low as 0.5%, less than $1/10^{th}$ of that previously thought to be required for inert, extrinsically added stabilizing particles.

While the minimum level of carbonate is at or near 0.5 wt. % to effectively create an aluminum melt capable of sustaining a foam in a reasonable time period, higher weight fractions of carbonate result in even more rapid attainment of the required melt stability. Low density aluminum foams have been produced with carbonate levels up to 16 wt. %. Such high levels of viscosity enhancing carbonate significantly reduce the time required to reach effective stability levels.

In another aspect of the present invention, a foamed aluminum product is provided comprising an aluminum alloy matrix comprising magnesium in a percentage ranging from about 0.5% to 8% by weight percent and a distribution of fine metallic oxides in a percentage ranging from 0.5% to about 16% by weight percent; wherein the average size of the fine metal oxides is less than 1.0 micron; and a distribution of pores within said aluminum alloy matrix comprising a majority of closed pores with an average diameter ranging from about 200 microns to about 1500 microns; wherein said distribution of pores within said aluminum alloy matrix provides a density between 0.30 g/cm$^3$ and 0.70 g/cm$^3$.

The metallic oxides are comprised of aluminum oxide, magnesium oxide and calcium oxide and mixed oxides of the same Further, the above aluminum foam may be substantially free of ceramic particles greater than 3 microns.

The foamed aluminum products made by the process of this invention exhibit improved properties such as low density and high rigidity, decreased thermal conductivity, and good tensile strength, impact resistance, energy absorption and sound deadening properties.

The foamed aluminum products may be used in various applications such as high performance lightweight automotive technology, thin sheet materials, architectural construction materials, buoyant applications, and any field where effective utilization of energy, high specific stiffness, and low density are required.

BRIEF DESCRIPTION OF THE DRAWINGS

A full understanding of the invention can be gained from the following description of the preferred embodiments when read in conjunction with the accompanying drawings in which.

DETAILED DESCRIPTION OF THE INVENTION

Figure 1:
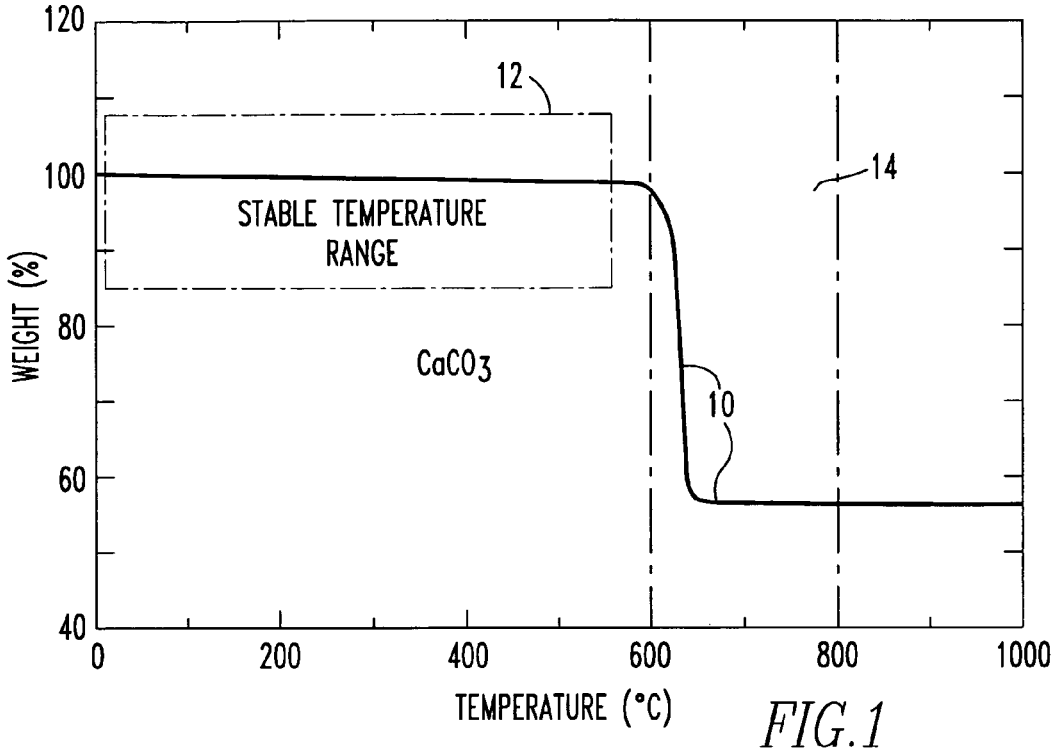
FIG. 1 is a graph of the weight % change as temperature is monotonically increased over time for calcium carbonate ($CaCO_3$), the most preferred additive of this invention, showing a decomposition temperature at ambient pressure in air of about 600° C. to 650° C.

The present invention provides an aluminum foam and a method for producing a foamed aluminum product, in which the method incorporates reactive gas producing particles having a decomposition temperature ranging from about 350° C. to about 850° C. into a molten metal alloy, wherein at least a portion of the reactive gas producing particles decomposes to provide a foamable suspension of metal oxide phases with minimal changes in pressure and temperature to the molten metal alloy. The present invention also provides an apparatus for practicing the method of the present invention comprising a reactor unit having a flow rate and volume configured to provide a sufficient transit time to decompose at least a portion of reactive gas producing particles in producing a foamable melt. The present invention is now discussed in more detail referring to the drawings that accompany the present application. In the accompanying drawings, like and/or corresponding elements are referred to by like reference numbers.

FIGS. 1-4 show TGA (Thermal Gravometric Analysis) graphs for a variety of materials to illustrate the range of decomposition of the reactive gas producing particles in terms of mass loss (wt % loss) over time as the sample decomposes under specific process conditions (temperature history, particle size, ambient environment, etc.) controlling the decomposition initiation and kinetics (rate). In FIGS. 1-4, the decomposition curve 10 is shown along with the preferred decomposition range 14 and the thermally stable range 12.

Figure 2:
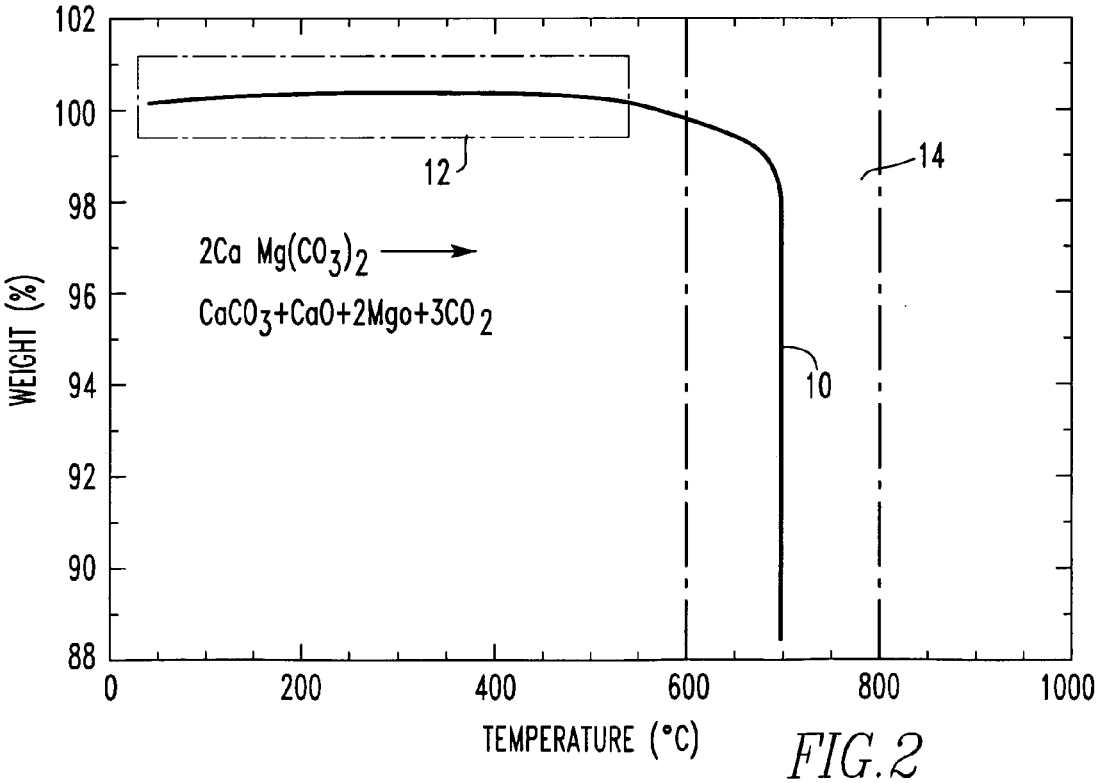
FIG. 2 is a graph of the weight percent change as temperature is monotonically increased over time for dolomite ($CaMg(CO_3)_2$), a preferred additive of this invention, showing a decomposition temperature at ambient in air of about 600° C. to 700° C.
Figure 3:
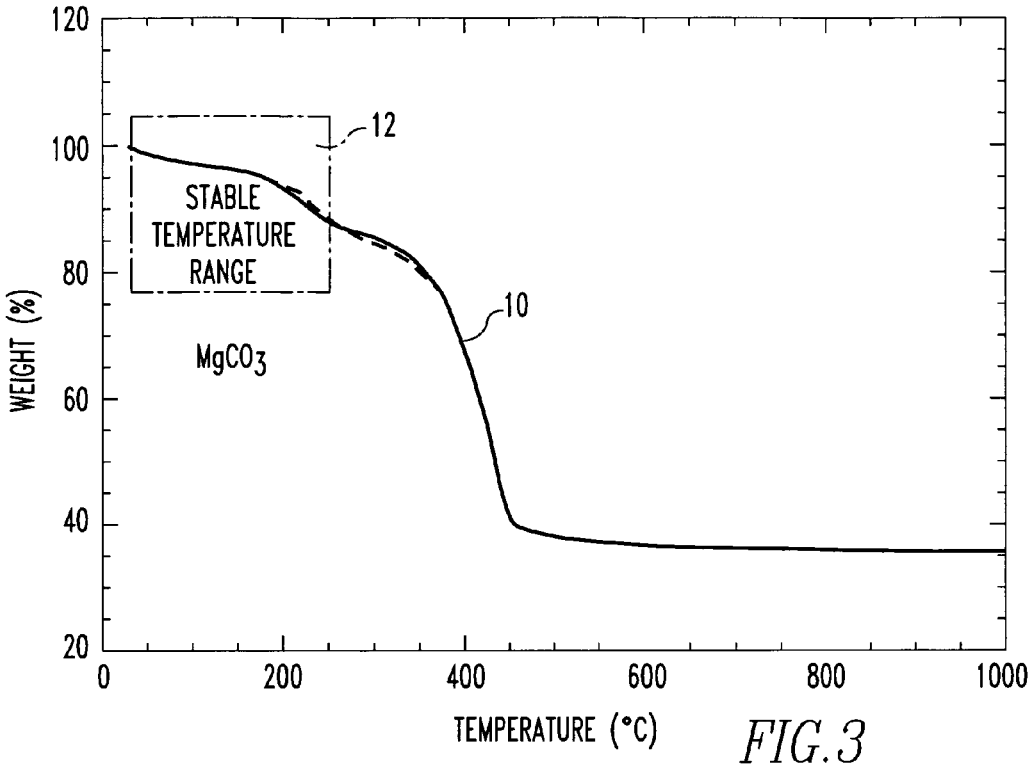
FIG. 3 is a graph of the weight % change as temperature is monotonically increased over time for magnesium carbonate ($MgCO_3$), showing a decomposition temperature at ambient in air of about 350° C. to 450° C.

The reactive gas producing particles found to be practical and useful in foamed aluminum production are carbonates, which are both effective and inexpensive, having a decomposition temperature as illustrated in the TGA (Thermal Gravometric Analysis) graphs plotted in FIGS. 1, 2 and 3. More specifically, the reactive gas producing particles are preferably carbonates having a decomposition temperature ranging from about 350° C. to about 850° C., even more preferably having a decomposition temperature ranging from about 550° C. to 850° C.

The preferred carbonates are calcium carbonate ($CaCO_3$) and/or dolomite ($CaMg(CO_3)_2$), wherein FIG. 1 illustrates the decomposition range for calcium carbonate and FIG. 2 illustrates the decomposition range for dolomite. These reactive gas producing particles undergo decomposition to form metallic oxide phases and carbon dioxide at temperatures which do not require that the temperature or pressure of the molten aluminum alloy be elevated to temperatures or pressures that are inconsistent with conventional aluminum processing.

Pure aluminum melts at approximately 660° C. Commercial aluminum alloys typically melt at lower temperatures than pure aluminum. More specifically, commercial aluminum alloys melt at temperatures ranging from approximately 560° C. to approximately 650° C., wherein the melting temperature of commercial aluminum alloy may vary depending on elemental additions within the alloy. The molten metal alloy utilized in the present invention can be, for example, at least one of commercial grade/purity molten aluminum, scrap aluminum, or aluminum containing Si and/or Mg, or the like.

Calcium carbonate begins to decompose at temperatures greater than 550° C., as depicted in FIG. 1, and dolomite decomposes at a slightly higher temperature than calcium carbonate, in which the decomposition temperature of dolomite begins at a temperature on the order of approximately 575° C. These compounds when utilized as the reactive gas producing particles, both having decomposition temperatures ranging from about 550° C. to about 650° C., demonstrate vigorous but not excessively energetic premature decomposition, allowing for adequate dispersion of the aluminum oxide phases produced by the interaction of the reactive gas producing particles and the molten alloy melt before the reactive gas producing particles exhaust their gassing ability.

The decomposition of calcium carbonate within the molten metal alloy is best described with reference to FIGS. 5 and 6. The decomposition of calcium carbonate within a molten metal alloy comprising aluminum and magnesium includes the following reactions:

$$CaCO_3 \rightarrow CaO + CO_2 \quad (1)$$

$$CO_2 + Al \rightarrow Al_2O_3 + CO \quad (2)$$

$$CaO + Al \rightarrow AlCaO_x \quad (3)$$

$$CO_2 + Mg \rightarrow MgO + CO \quad (4)$$

Figure 5:
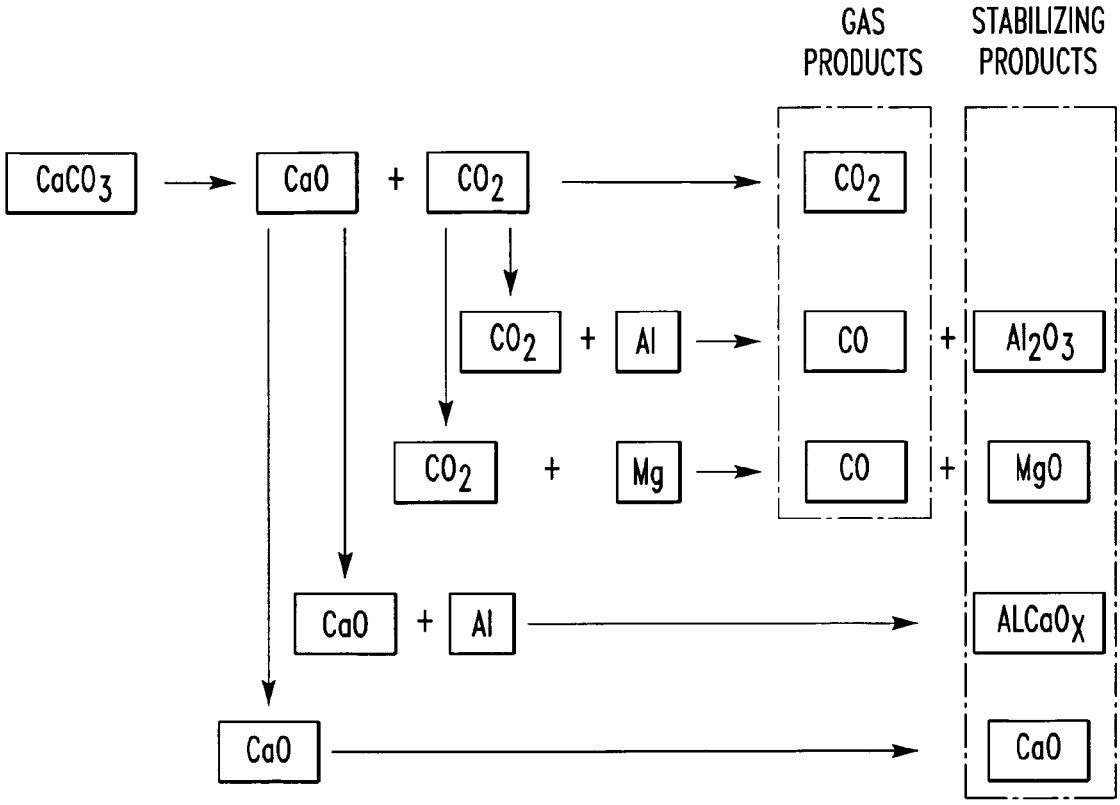
FIG. 5 illustrates the chemical reactions in the evolution of the reactions for vigorous decomposition of calcium carbonate in a molten metal comprising aluminum and magnesium and the formation of metallic oxides.
Figure 6:
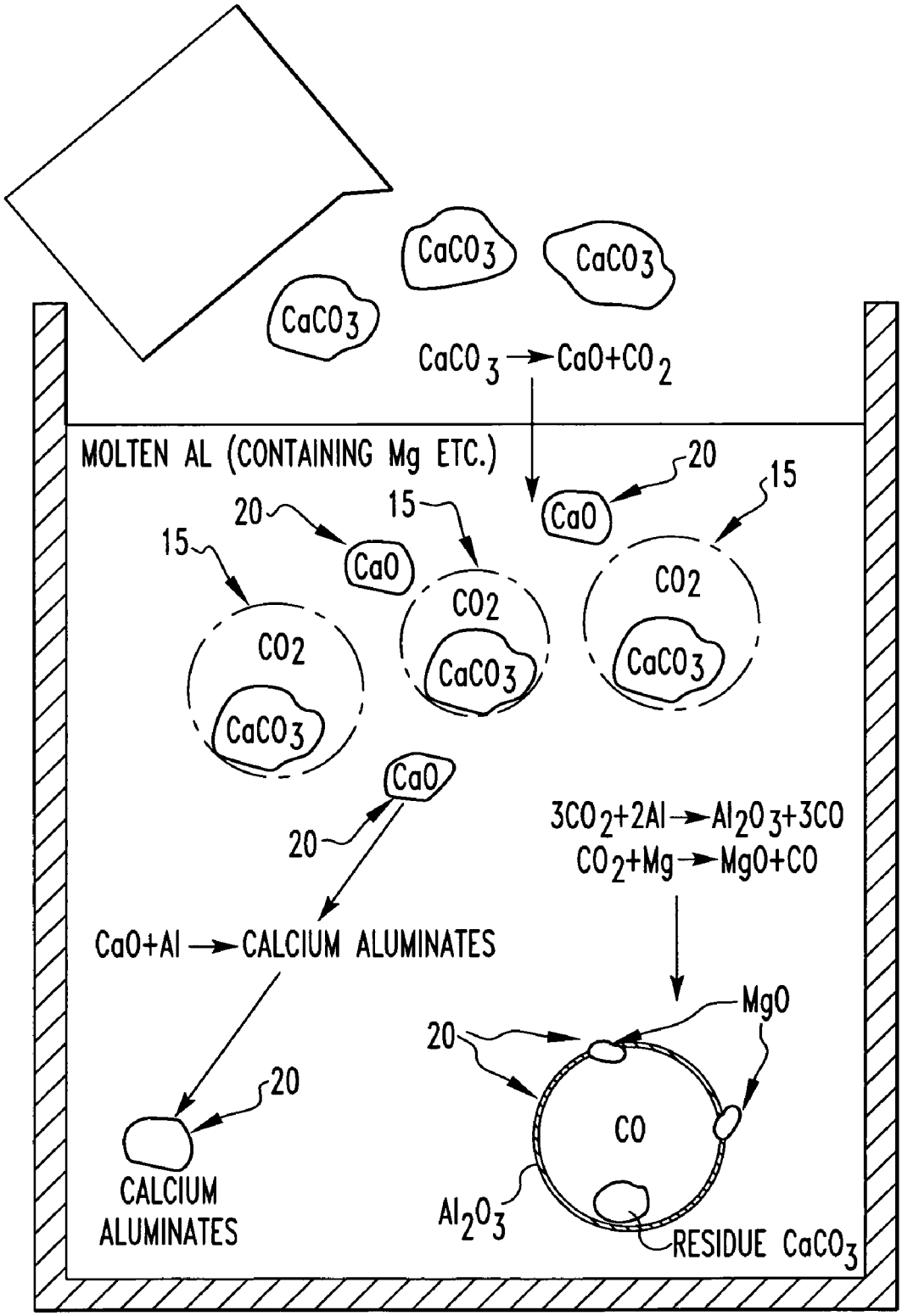
FIG. 6 is a pictorial representation showing the evolution of the reactions for decomposition of calcium carbonate in a molten metal comprising aluminum and magnesium and the formation of metallic oxides.

FIG. 5 depicts the decomposition reactions of calcium carbonate in molten metal alloy and the interaction of decomposition products with the aluminum and magnesium that is present in the molten metal alloy to produce gas products (reactive gas) and stabilizing products. The gas products (reactive gas) vigorously combines with the aluminum and magnesium of the molten metal alloy to produce aluminum oxide phases, such as alumina ($Al_2O_3$) and magnesium oxide (MgO), in which the aluminum oxide phases are stabilizing products that contribute to forming a foamable suspension. FIG. 6 is a pictorial representation of decomposition of the reactive gas producing product within the molten metal alloy to produce gas products 15 and the stabilizing products 20. It is noted that although magnesium is included in the above example, the present invention may be practiced without the incorporation of magnesium within the molten metal alloy. Additionally, the molten metal alloy can be, for example, at least one of commercial grade/purity molten aluminum, scrap aluminum, or aluminum containing Si and/or Mg, or the like.

The decomposition reactions in which dolomite is included into the molten metal alloy as the reactive gas producing particles comprise:

$$2CaMg(CO_3)_2 \rightarrow CaCO_3 + CaO + 2MgO + 3CO_2$$

$$3CO_2 + Al \rightarrow Al_2O_3 + 3CO$$

$$CaO+Al \rightarrow AlCaO_x$$

$$CO_2+Mg \rightarrow MgO+CO$$

Although calcium carbonate and dolomite are highly preferred embodiments of the present invention, other carbonates have been contemplated and are therefore within the scope of the present invention.

For example, referring to FIG. 3 depicting a TGA plot for magnesium carbonate ($MgCO_3$), magnesium carbonate has been considered for application as a reactive gas producing particle. As a result of the low decomposition temperature for magnesium carbonate, magnesium carbonate is more difficult to disperse prior to the onset of decomposition than calcium carbonate and dolomite, and while magnesium carbonate is useful, it is not preferred alone.

Figure 4:
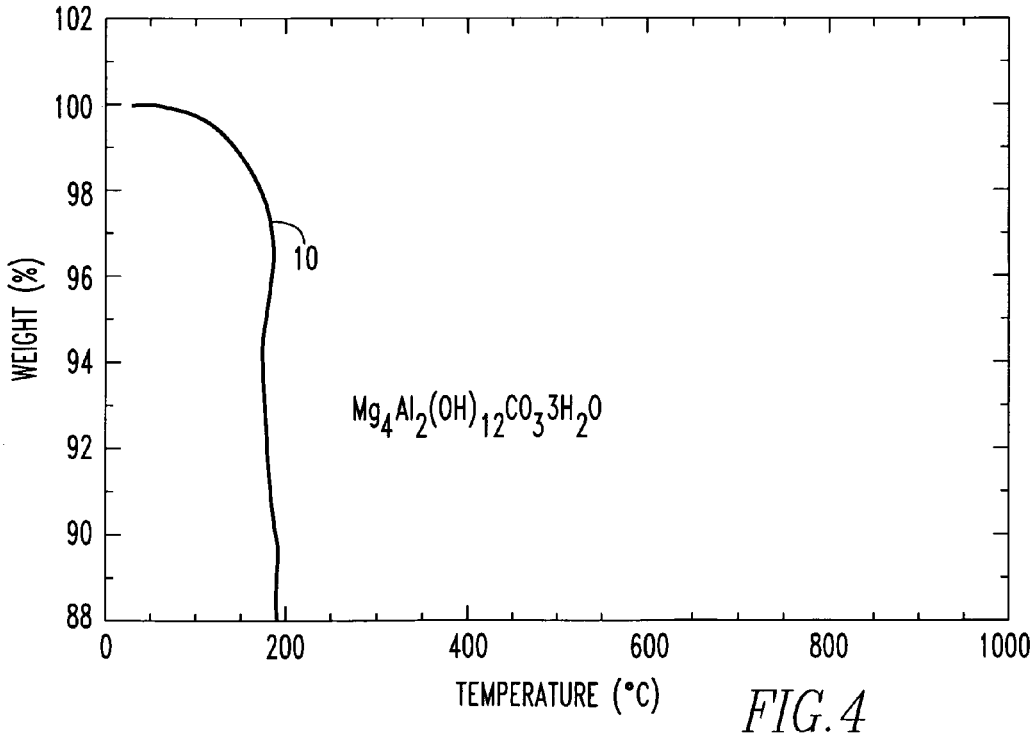
FIG. 4 is a graph of the weight percent change as temperature is monotonically increased over time for hydrotalcite ($Mg_4Al_2(OH)_{12}CO_3H_2O$), showing a decomposition temperature at ambient in air of about 175° C. to 200° C.

Referring now to FIG. 4, depicting a TGA plot for hydrotalcite ($Mg_4Al_2(OH)_{12}CO_3H_2O$) having a decomposition temperature at ambient in air of about 175° C. to 200° C., hydrotalcite is insufficient as a reactive gas producing particle as resulting in premature decomposition when incorporated into a molten metal alloy comprising aluminum.

The selection of carbonates with higher decomposition temperatures than $CaCO_3$ and dolomite, while inappropriate for the production of aluminum foams, may be ideally suited for metals with higher melting temperatures, such as copper, titanium, steel or brass. Similarly, the carbonates with substantially lower decomposition temperatures than those selected for aluminum may be ideally suited for low melting metallic systems, such as lead, tin and magnesium alloys.

Table 1 shows carbonate thermodynamic equilibrium temperatures of carbonates abundant in nature at approximately 0.01 atmosphere of partial pressure of $CO_2$ (which is approximately the partial pressure of $CO_2$ in the ambient atmosphere). This is a thermodynamic equilibrium summary, not a kinetic summary, but it helps to show the relative decomposition order of the carbonates and provides an estimate of decomposition temperatures in the molten metal. These suggest examples of carbonates that would be ineffective for use in aluminum as their decomposition temperatures lie outside of the 350° C. to 850° C. range.

TABLE 1

Thermodynamic Equlibrium Temperatures for Assorted Carbonates at 0.01 atm Partial Pressure $CO_2$

| Carbonate | ° C. |
|---|---|
| $NaHCO_3$ | 52 |
| $ZnCO_3$ | 61 |
| $Ag_2CO_3$ | 122 |
| $CdCO_3$ | 231 |
| $MnCO_3$ | 249 |
| $MgCO_3$ | 283 |
| $CaCO_3$ | 656 |
| $SrCO_3$ | 865 |
| $Li_2CO_3$ | 1016 |
| $Ba_2CO_3$ | 1088 |

Thus, using Table 1 only to screen out likely ineffective carbonates, it's evident that carbonates of Na, Zn, Ag, Cd and Mn would have too low a decomposition temperature for commercial manufacture of aluminum foam because they would be far too rapid in their decomposition to allow for adequate dispersion. Alternately, Sr, Li and Ba carbonates would have too high a decomposition temperature and would not decompose or would decompose at a very slow rate not appropriate for a viable commercial process. Note that at these partial pressures, the equilibrium temperature of $CaCO_3$ and $MgCO_3$ are not that different from their respective TGA decomposition temperatures.

Turning back to the embodiments of the present invention in which calcium carbonate is selected for the reactive gas producing particles, when added to prepare the molten aluminum for viscosity enhancement, the calcium carbonate particle size can be from about 0.5 micrometer to 40 micrometer. The amount added is in the range of from 0.5 wt. % to 16 wt. % of the total aluminum melt mass and preferably 0.5 wt. % to 2 wt. %. It has been determined that small volume fractions of calcium carbonate are highly effective to control melt viscosity and/or surface energy to maintain a stable foam.

Alternatively, the calcium carbonate particle sizes can be as large as 40 micrometer to 150 micrometer. At this size the reaction rates are markedly slower, and there will be incomplete decomposition of the carbonate after 10 minutes. Nevertheless, sufficient reactive gas will be generated to stabilize the aluminum melt. The residual unreacted carbonate can then be used as a foaming agent in the melt. Thus, depending on the product and process requirements, carbonate can be added in multiple steps, with multiple particle size distributions to achieve various levels of viscosity enhancement and various levels of foaming.

If added to both stabilize and foam the melt in a single addition, then the particle sizes can be from about 0.5 micrometer to 150 micrometer. The optimal mixture of particle sizes is dependent on the desired mixing time as smaller particles decompose first and are more effective at increasing the viscosity leaving the larger particles to provide the gas for the final foaming.

Foaming agents must be selected to have good stability at low temperatures and decompose to produce foaming gas at temperatures at or above the melting point of the metal alloy. The size of the foaming agents introduced into the molten metal or alloy can be selected based on the desired rate of foam generation and on the structure of the foam desired. In casting foamed aluminum, the size and composition of the foaming agents introduced into the melt affects the size and number density of the bubbles produced. By controlling the size of the bubbles produced in a foamed aluminum mass, the net density can be targeted so that properties such as thermal conductivity, strength or crush energy absorption can be controlled.

Examples of suitable practical foaming agents for use in aluminum foam production include magnesium carbonate, calcium carbonate, dolomite, and metal hydrides such as titanium hydride and zirconium hydride, and mixtures thereof. The foaming agents may have any desired morphology. They can be added in one or more stages in the process. In one embodiment, the foaming agents have particle sizes between about 0.5 micrometer to about 40 micrometer. In another embodiment, the foaming agents have an average size of from about 40 micrometers to about 150 micrometer.

Figure 7:
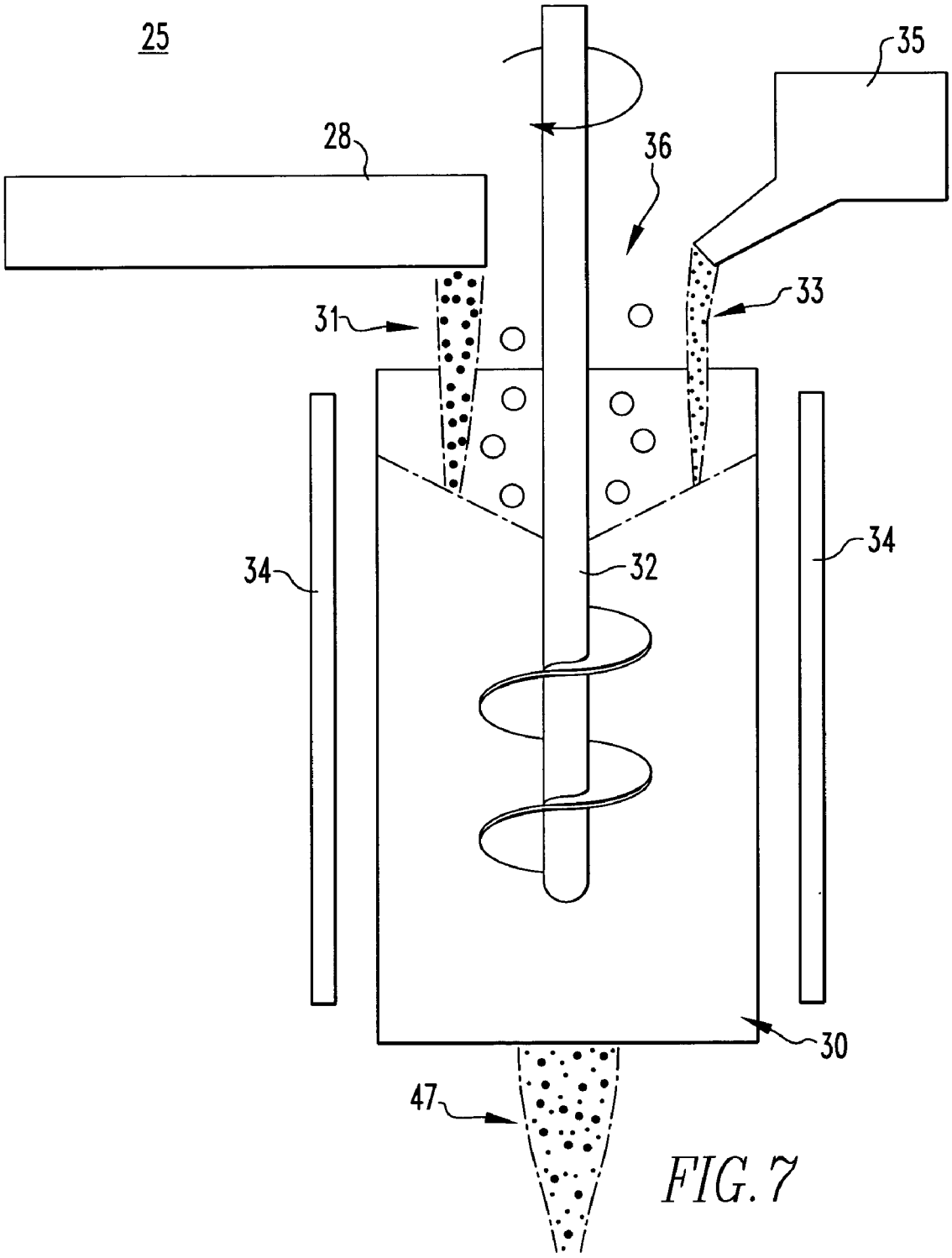
FIG. 7 (cross-sectional view) depicts an apparatus for producing aluminum foam, in which a viscosity agent and foaming agent are provided by the single addition of reactive gas producing particles.

Referring now to FIG. 7, in another aspect of the present invention an apparatus 25 is provided that produces a foamed aluminum product using the above-described reactive gas producing particles. The apparatus includes a means for introducing a molten metal alloy 28 and a feed system 35 for introducing reactive gas producing particles 33 into a reactor unit 30, wherein the reactive gas producing particles 33 vigorously decomposes within the molten metal alloy 31 to provide a foamable suspension. The means for introducing the molten metal alloy 28 provides the molten metal alloy 31 at a pre-selected flow rate.

The reactor unit 30 comprises a mixing passage with a stirrer 32 contained, wherein the mixing passage is housed by a furnace 34. The mixing passage and the stirrer 32 combine reactive gas producing particles 33 with the molten metal alloy 31 to increase the viscosity/modify the surface energy of the aluminum melt. The dimensions of the mixing passage and the stirrer 32 are selected to provide an effective volume that when utilized in conjunction with the pre-selected flow rate provides a transit time of the molten metal alloy containing the reactive gas producing particles sufficient to provide that at least a portion of the reactive gas producing particles decompose within the mixing passage to provide a foamable suspension. Further, the agitation provided by the stirrer, the composition and/or particle size of the reactive gas producing particles, and the composition of the molten metal alloy may be configured to modify the transit time.

The reactor unit 30 may further comprise at least one vent for releasing the unreacted portions of the gaseous product of the decomposition of the reactive gas producing particles, as well as the gaseous products of the reaction itself. In the preferred case in which the reactive gas producing particle is calcium carbonate, the unreacted portion of the $CO_2$ gas may be vented along with the CO reaction product produced through the reaction of $CO_2$ with the aluminum alloy melt. As CO is a flammable gas, this by-product can be safely flamed off at the surface of the reactor unit 30.

In one embodiment of the present invention, the transit time within the mixing passage is selected to decompose only a portion of the reactive gas producing particles 33 leaving a remaining portion of the reactive gas producing particles unreacted. In this embodiment of the present invention, the unreacted portions of the reactive gas producing particles function as a foaming agent in a foamable suspension 47.

Figure 8:
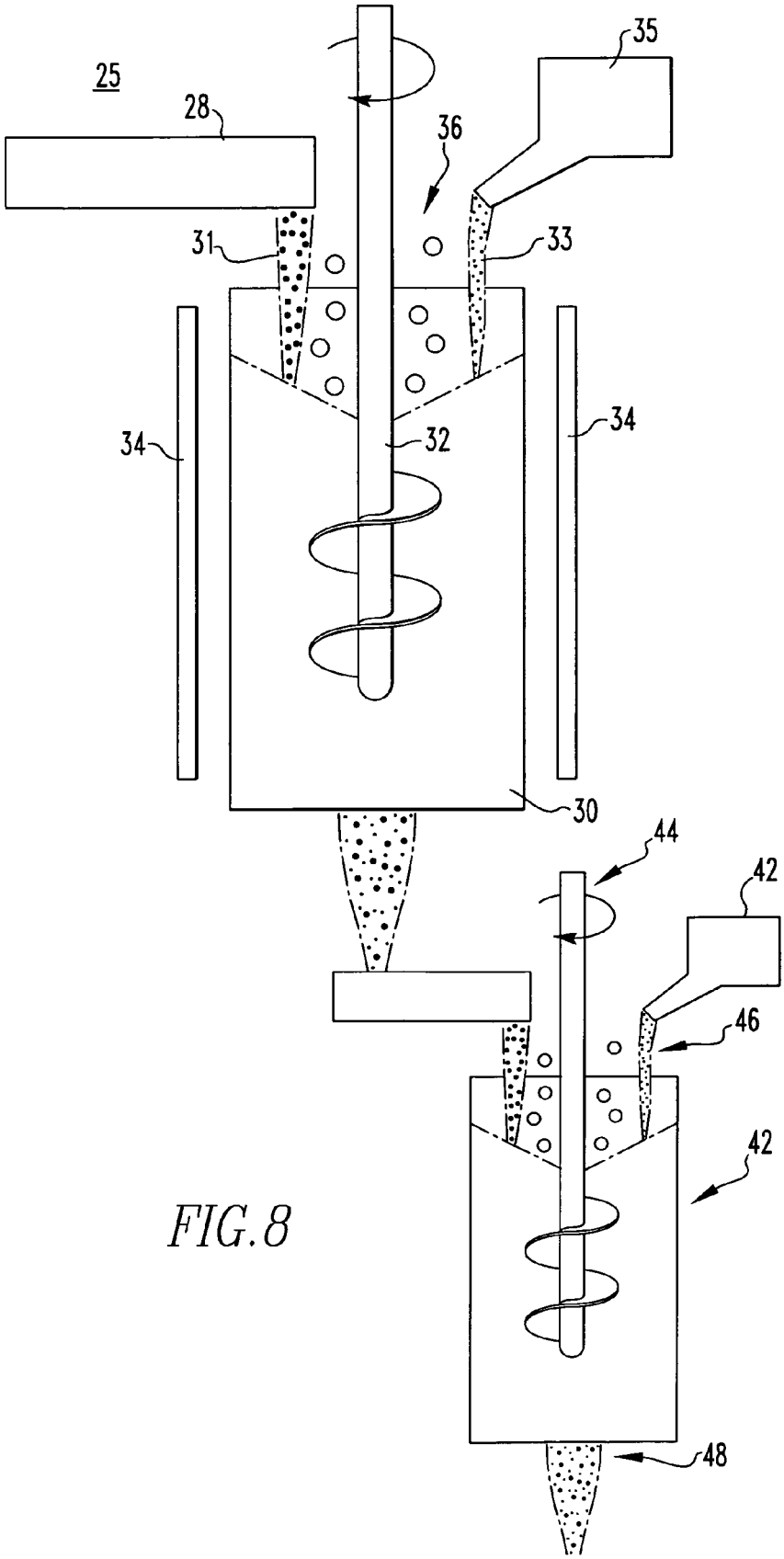
FIG. 8 (cross-sectional view) depicts a chemical foaming agent dispersion apparatus compatible with the apparatus depicted in FIG. 7.

In another embodiment of the present invention the transit time within the mixing passage is selected to fully decompose the reactive gas producing particles 33. As shown in FIG. 8, the viscosity enhanced alloy melt may then flow into the foaming agent dispersion unit 42 with stirrers 44, where the foaming agents 46 would be added to produce an inoculated foamable molten aluminum feedstock 48. Although not depicted in the supplied figures, in another embodiment of the present invention the inoculated foamable molten aluminum feedstock may be passed to optional caster-type device to form ingots which could later be remelted in a furnace prior to the addition of the foaming agent. Another gas vent 37 can optionally exhaust excess gas from the foaming agent dispersion unit 42.

The inoculated foamable molten aluminum feedstock 48 can then be passed to a foaming unit to form continuous products (plates, sheets, bars, extrusions, etc.) or to be processed, for example, by a continuous belt caster, roll caster, vertical caster or the like (not shown) to provide liquid foamed/cellular sheet which upon cooling can be used itself or laminated to other materials. Optionally, the inoculated foamable molten aluminum feedstock 48 can be passed to mold or hollow part where it can be foamed and cooled to form a molded product, or interior or exterior of a part. Also optionally, inoculated foamable molten aluminum feedstock 48 could be very quickly passed to the freezing unit before significant foaming occurs to produce a foamable solid precursor for other product applications. As research has shown, surprisingly, aluminum foams produced from remelted foamable solid precursors result in a coarsening of foam cell sizes. This process can be used to create metal foams at a larger cell size, which may be appropriate for many final applications.

The aluminum foam of the present invention may be processed to provide a structural materials for construction, automotive, or aerospace applications. In some embodiments, the aluminum foam may be processed to provide a flat panel. This flat panel of aluminum foam is applicable for flooring, roofing, and walling utilized in construction.

Optionally, the inoculated foamable molten aluminum feedstock 48 can be passed to mold or hollow part where it can be foamed and cooled to form a molded product, or interior or exterior of a part.

The following examples are provided to further illustrate the present invention and demonstrate some advantages that arise therefrom. It is not intended that the invention be limited to the specific examples disclosed.

EXAMPLE 1

Effect of Reactive Gas Producing Particles on Stability in Aluminum Alloy Foams A series of aluminum alloy melts were prepared to determine the effect of calcium carbonate on the stability of the aluminum foam and the propensity for gravitational drainage in the foamed structure. Specimens comprising 100 gm of an aluminum-2 wt. % magnesium alloy were melted and stirred vigorously for different times while adding various weight fractions of calcium carbonate powders. Following agitation, a separate chemical foaming agent was added and dispersed for 30 seconds. In these tests that chemical foaming agent was calcium carbonate. The various specimens were then foamed and the rise of the aluminum foam monitored.

Figure 9:
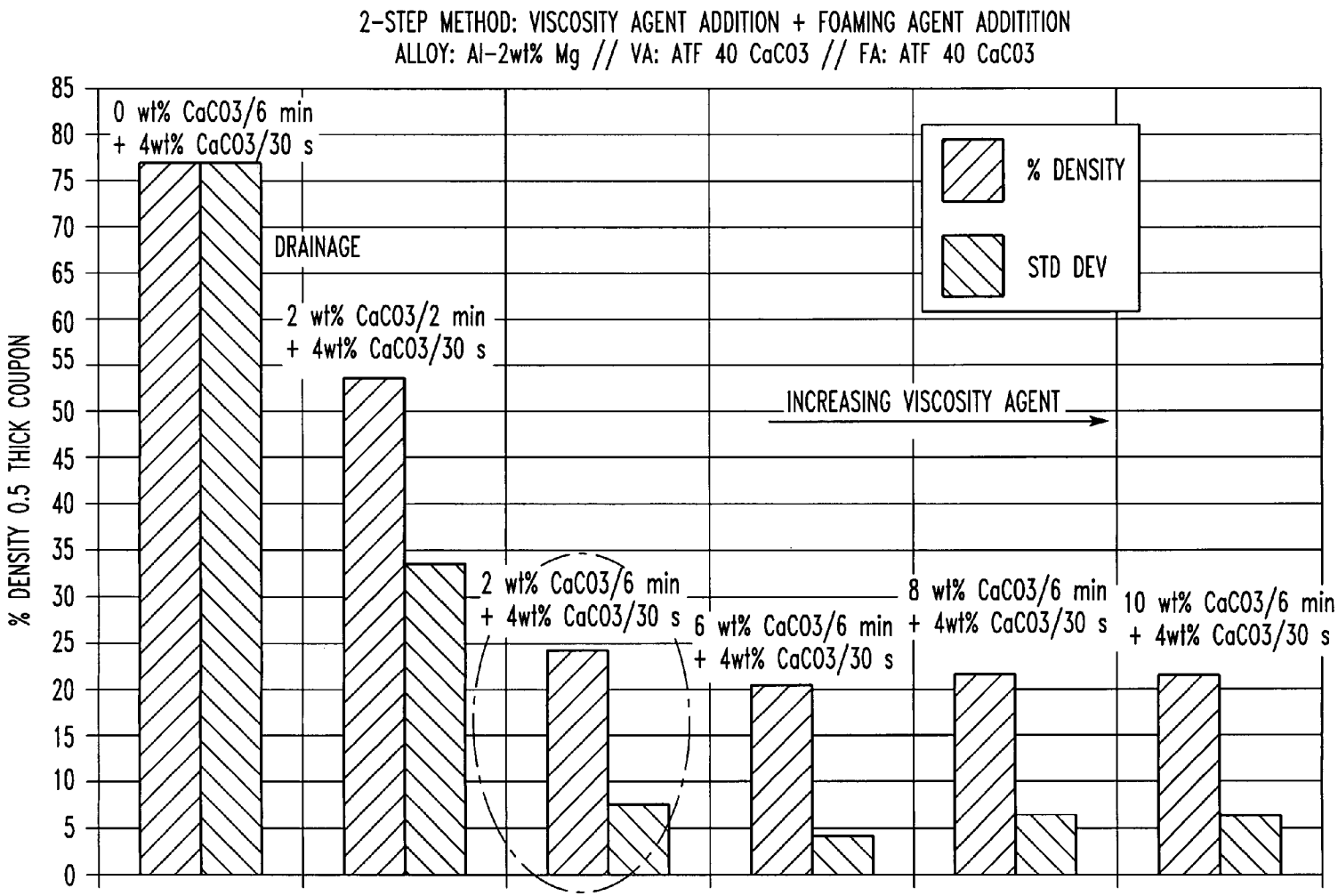
FIG. 9 depicts a chart illustrating the effects of reactive gas producing particles on the stability of aluminum alloy foams.

Following foaming, the specimens were rapidly cooled and foam specimens sectioned, weighed, photographed, and the density calculated. The results of these tests are shown in FIG. 9. The results clearly show the role of calcium carbonate in creating a stabilized aluminum melt and the impact of the carbonate decomposition products on the structure.

In specimen S-787295, wherein no reactive gas producing particles ($CaCO_3$) were added and the melt was simply agitated in air for 6 minutes, the subsequent dispersion of chemical foaming agent and foaming operations resulted in a foam of exceptionally poor quality. Relative density (compared to aluminum) was 77% of the base metal. Standard deviation, taken from the set of specimens sectioned from top to bottom of the foamed product, was at this same level, indicating that the specimen suffered substantial gravitational drainage. These data clearly show the ineffectiveness of simple agitation in air (the incumbent method) in stabilizing aluminum melts for foaming.

In specimen S-787293 (again shown in FIG. 9), wherein 2 wt. % calcium carbonate is added to the melt, but only agitated for 2 minutes, the specimen shows the ineffectiveness of insufficient decomposition of the reactive gas producing particles in stabilizing the aluminum foam. Here, the abbreviated agitation period (2 minutes stirring) results in the creation of an aluminum matrix with insufficient levels metallic oxide phases. Subsequent addition and dispersion of chemical foaming agent, followed by foaming, and subsequent cooling, results in a foam product with a relative density of 54%, far too high to be considered an attractive foam product. With a standard deviation between different sections of the foam equal to approximately 34%, it is clear that the foamed product suffers from severe gravitational drainage. This result can be compared to that of specimen S-787296, where all experimental parameters were identical with the exception of extending the stirring time to 6 minutes. Here attractive relative densities of 24% were achieved, and significantly, standard deviation between foam sections dropped to 7%, indicative of a highly uniform density in the foamed product.

Higher levels of gas producing particles, such as 4 wt. %, 8 wt. % and 10 wt. % calcium carbonate for specimens S-787291, S-787294, S-787299, respectively, show modest changes in foam density and resistance to gravitational drainage. For this particular alloy composition and particle size distribution of calcium carbonate, a minimum of a 2 wt. % addition and a 6 minute agitation period is required to stabilize the melt.

EXAMPLE 2

Effect of $CaCO_3$ Particle Size Distribution on Foam Structure

Figure 10:
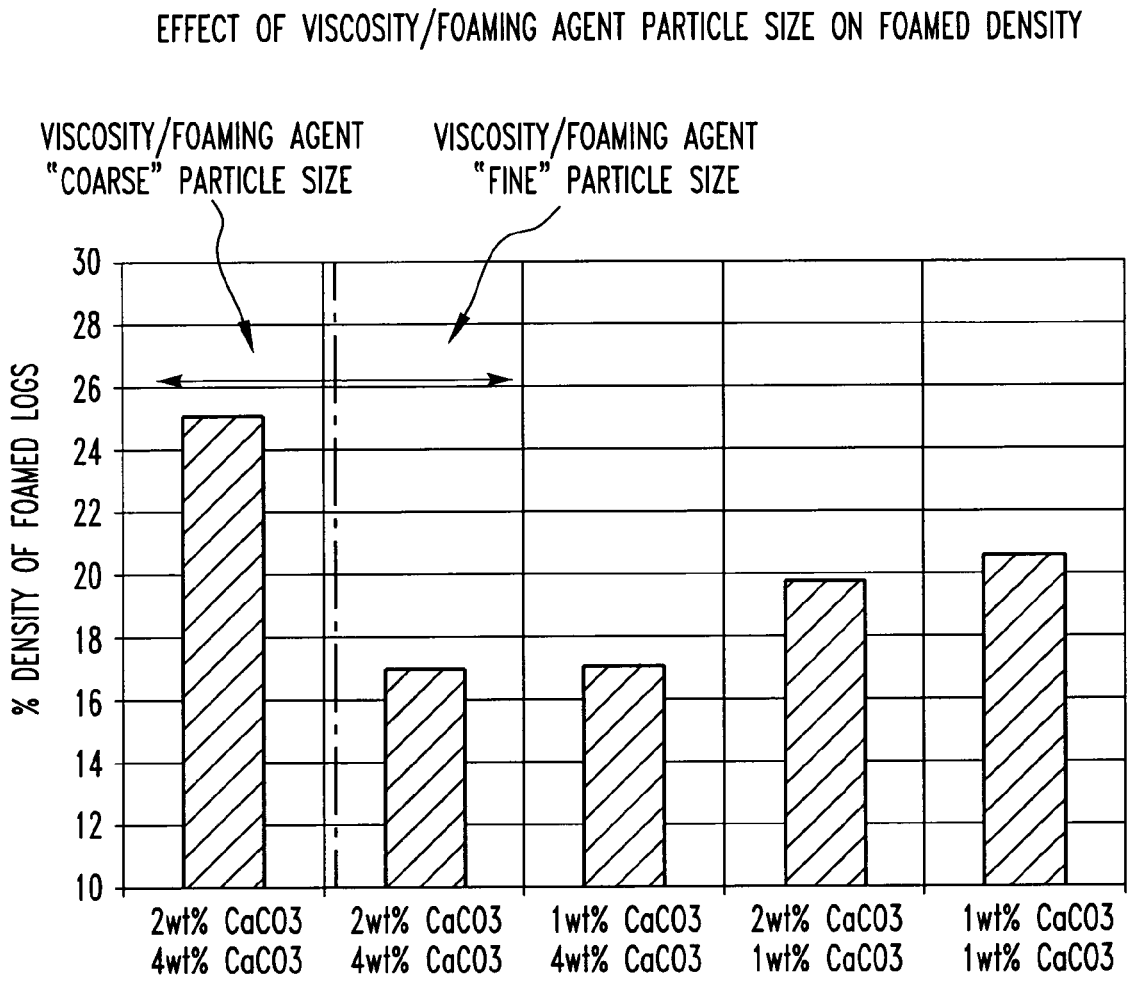
FIG. 10 depicts a chart illustrating the effects of calcium carbonate particle size on the structure of aluminum alloy foams.

A series of aluminum alloy melts were prepared to determine the effect of size and weight fraction of calcium carbonate (reactive gas producing particles) on the stability of the aluminum foam and the propensity for gravitational drainage in the foamed structure. Specimens comprising 100 gm of an aluminum-2 wt. % magnesium alloy were melted and stirred vigorously for 6 minutes after adding various weight fractions of calcium carbonate powders. The results of this experimentation are shown in FIG. 10, in which particles labeled "coarse" correspond to volume average diameters of 150 microns, while those labeled as "fine" correspond to volume average diameters of 40 microns. The finer carbonates clearly show greater efficacy in stabilizing the aluminum melt. At a 2 wt. % carbonate addition, the "coarse" addition resulted in a average foam density of 25%, while the "fine" particles resulted in a density of 17%. This finer carbonate addition allows for the effective weight fraction of the viscosity enhancement to be brought down to 1%, as shown in FIG. 10. These data suggest that even finer carbonate distributions will result in lower minimum levels of viscosity addition.

EXAMPLE 3

Effect of Magnesium Addition on Stabilization of Aluminum Foams

Figure 11:
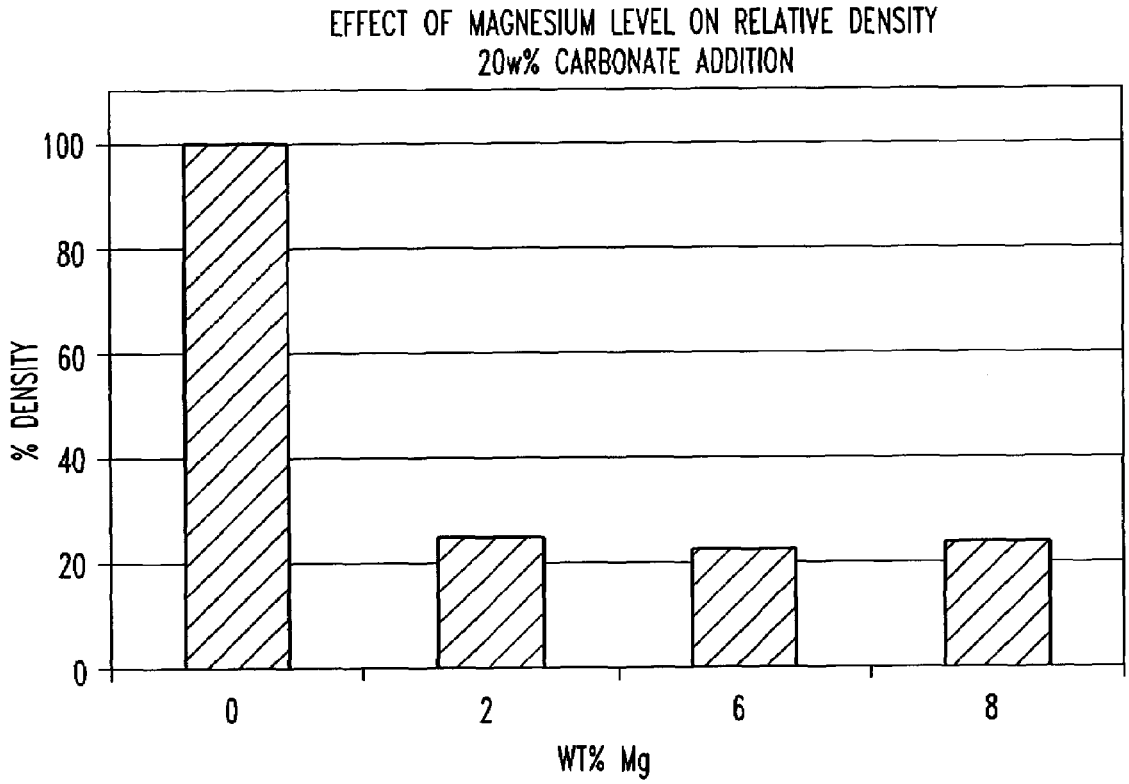
FIG. 11 depicts a chart illustrating the effects of magnesium addition to molten metal alloys for producing aluminum foams.

A series of aluminum alloy melts were prepared to determine the effect of magnesium level on the stability of the aluminum foam and the propensity for gravitational drainage in the foamed structure. Specimens comprising 100 gm of an aluminum and various levels of magnesium were melted and stirred vigorously after adding 20 wt. % calcium carbonate powders. The results are shown in FIG. 11. A marked effect is seen on the addition of 2 wt. % Mg (for this particular carbonate size and weight fraction), with relative density of the foam product dropping from near full density to 25 wt. %. Higher additions of Mg have limited effect on foam density itself.

EXAMPLE 4

Figure 12:
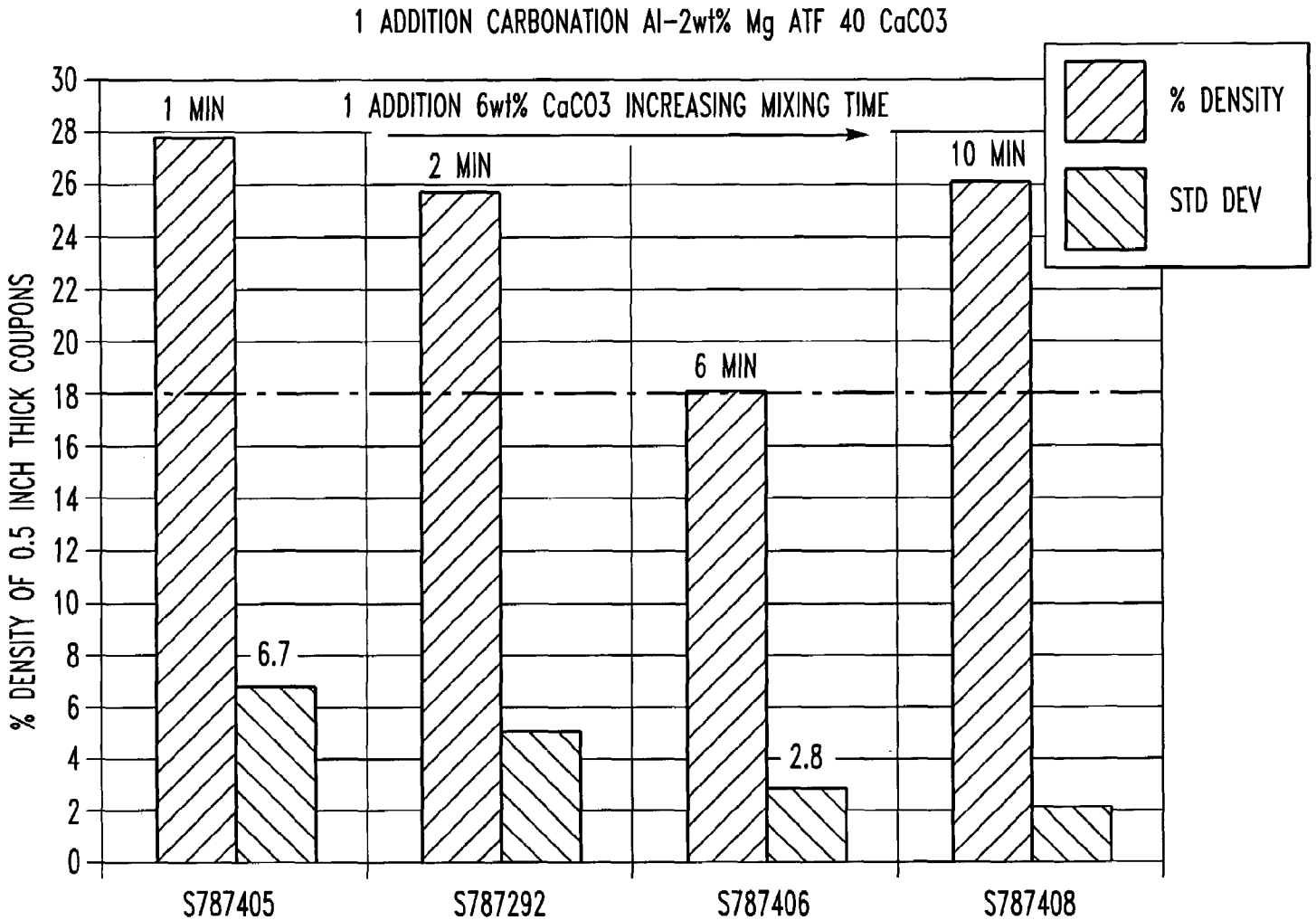
FIG. 12 depicts a chart illustrating the effects of mixing time on a single addition of reactive gas producing particles for a stabilizing additive and as a foaming agent.

Single Step Production of Aluminum Foam using Unexpended Stabilizing Additive as Foaming Agent A series of aluminum alloy melts were prepared to determine the effect of agitation time of the reactive gas producing particles on the density and stability of the aluminum foam and the possibility of producing inoculated (inoculated defined here as melt plus unreacted foaming agent) foamable charge in a single agitating step. FIG. 12 shows the results of 100 gm specimens of an aluminum-2 wt. % magnesium alloy that were melted and stirred vigorously for various times following the addition of carbonate. For these carbonate sizes, the results show an optimum agitation time of approximately 6 minutes to render the lowest foam relative density-18%.

Shorter agitation times show the effects of insufficient levels of stabilization, expressed by increasing density from top to bottom of the foam. At 10 minutes of agitation, however, insufficient unreacted carbonate remains to drive the expansion of the foam during the foaming step, resulting in a rise in the relative density. Thus 10 minutes of agitation, while providing the highest degree of stabilization (as judged by the low standard deviation between density readings) does not provide the best balance of stabilization and residual foam efficacy.

EXAMPLE 5

Figure 13:
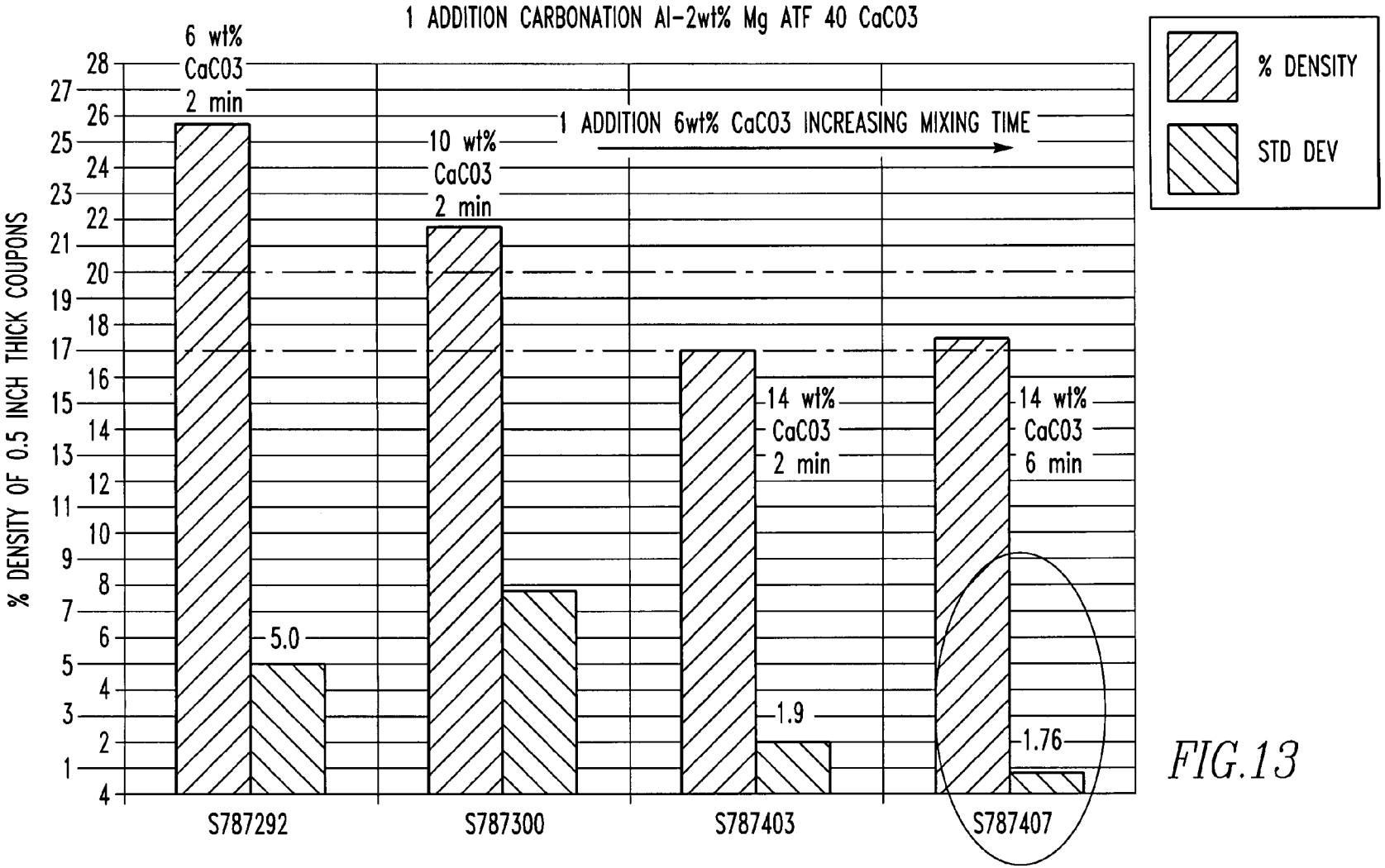
FIG. 13 depicts a chart illustrating the effects of increasing wt. % of reactive gas producing particles with a single addition of reactive gas producing particles for a stabilizing additive and as a foaming agent.

Single Step Production of Aluminum Foam using Unexpended Stabilizing Additive as Foaming Agent A series of aluminum alloy melts were prepared to determine the effect of agitation time and weight fraction of the reactive gas producing particles on the density and stability of the aluminum foam and the possibility of producing inoculated foamable charge in a single agitating step. FIG. 13 shows the results of 100 gm specimens of an aluminum-2 wt. % magnesium alloy that were melted and stirred vigorously for various times following the addition of carbonate. For these carbonate sizes, the results show increasing stabilization with either increased agitation time or increased carbonate level, again, as judged by the standard deviation of density taken from top to bottom. Single additions are calcium carbonate are increased from 8 wt. % to 14 wt. % and agitation times varied from 2 minutes to 8 minutes, with resulting densities as low as 17%.

While the present invention has been particularly shown and described with respect to the preferred embodiments thereof, it will be understood by those skilled in the art that the foregoing and other changes in forms of details may be made without departing form the spirit and scope of the present invention. It is therefore intended that the present invention not be limited to the exact forms and details described and illustrated, but fall within the scope of the appended claims.

What is claimed is:

1. A method of making an aluminum foam product comprising:

adding reactive gas producing particles to a molten aluminum alloy at a temperature that is above the decomposition temperature of the reactive gas producing particles so that, at least a portion of the reactive gas producing particles produce reactive gas of carbon dioxide;

reacting the carbon dioxide with the molten aluminum alloy at a sufficient melt temperature of the alloy, sufficient ratio of the reactive gas producing particles to the molten aluminum alloy, sufficient residence time and sufficient particle size of the reactive gas producing particles so as to produce at least $Al_2O_3$,CO and a foamable suspension, wherein the foamable suspension is resistant to coalensense and drainage;

adding a chemical foaming agent to the foamable suspension;

mixing the foamable suspension with the chemical foaming agent to form an inoculated foamable suspension;

foaming the inoculated foamable suspension; and forming a foamed aluminum product.

2. The method of claim 1, wherein the reactive gas producing particles are selected from the group consisting of magnesium carbonate, calcium carbonate, dolomite and mixtures thereof.

3. The method of claim 1, wherein the reactive gas producing particles are calcium carbonate.

4. The method of claim 1, wherein the chemical foaming agents are selected from the group consisting of magnesium carbonate, calcium carbonate, dolomite, titanium hydride, zirconium hydride and mixtures thereof.

5. The method of claim 4, wherein the chemical foaming agents are calcium carbonate.

6. The method of claim 1, wherein the molten metal alloy comprises commercial grade purity aluminum, scrap aluminum, aluminum containing silicon and magnesium, or mixtures thereof.

7. The method of claim 3, wherein the calcium carbonate has an volume averaged size of less than 40 microns.

8. The method of claim 3, wherein the calcium carbonate comprises between 0.5 wt. % and 4 wt. % of the molten metal alloy.

9. The method of claim 5, wherein the calcium carbonate constitutes between 0.5 wt. % and 4 wt. % of the molten metal alloy.

10. The method of claim 1, wherein the molten metal alloy contains between 0.5% and 8% magnesium by weight percent.

11. A method of making an aluminum foam product comprising:

adding reactive gas producing particles to a molten aluminum alloy that is at a temperature above the decomposition temperature of the reactive gas producing particles so that, at least a portion of the reactive gas producing particles produce reactive gas of carbon dioxide;

reacting the carbon dioxide with the molten aluminum alloy at a sufficient melt temperature of the alloy, sufficient ratio of the reactive gas producing particles to the molten aluminum alloy, sufficient residence time and sufficient particle size of the reactive gas producing particles so as to produce at least $Al_2O_3$, CO and a foamable suspension, wherein the foamable suspension is resistant to coalenscence and drainage;

retaining a portion of the reactive gas producing particles as a chemical foaming agent;

mixing the foamable suspension with the chemical foaming agent to form an inoculated foamable suspension;

foaming the inoculated foamable suspension; and forming a foamed aluminum product.

12. The method of claim 11, wherein the reactive gas producing particles are selected from the group consisting of magnesium carbonate, calcium carbonate, dolomite and mixtures thereof.

13. The method of claim 12, wherein the reactive gas producing particles are calcium carbonate.

14. The method of claim 11, wherein the molten metal alloy comprises commercial grade purity aluminum, scrap aluminum, aluminum containing silicon and magnesium, or mixtures thereof.

15. The method of claim 13, wherein the calcium carbonate has an volume averaged size of less than 40 microns.

16. The method of claim 13, wherein the calcium carbonate comprises between 2% and 16% of the molten metal alloy by weight percent.

17. The method of claim 14, wherein the molten metal alloy comprises between 0.5% and 8% magnesium by weight percent.

18. The method of claim 11, wherein the inoculated foamable melt is solidified and remelted prior to said foaming the inoculated foamable melt to provide the liquid metal foam.

* * * * *